United States Patent [19]

Lohberg

[11] Patent Number: 4,936,972

[45] Date of Patent: Jun. 26, 1990

[54] MEMBRANE ELECTROLYZER

[75] Inventor: Karl Lohberg, Heusenstamm, Fed. Rep. of Germany

[73] Assignee: Metallgesellschaft Aktiengesellschaft, Frankfurt am Main, Fed. Rep. of Germany

[21] Appl. No.: 324,370

[22] Filed: Mar. 15, 1989

[30] Foreign Application Priority Data

Mar. 15, 1988 [DE] Fed. Rep. of Germany ..... 3808495

[51] Int. Cl.[5] ..... C25B 9/00

[52] U.S. Cl. ..... 204/252; 204/282; 204/283

[58] Field of Search ..... 204/98, 128, 129, 252, 204/280, 283, 282

[56] References Cited

U.S. PATENT DOCUMENTS

| | | | |
|---|---|---|---|
| 3,940,328 | 2/1976 | Thomas et al. | 204/252 |
| 4,138,295 | 2/1979 | Denora et al. | 204/98 |
| 4,417,970 | 11/1983 | Yamaguchi et al. | 204/257 |
| 4,557,816 | 12/1985 | Yoshida et al. | 204/283 |

*Primary Examiner*—John F. Niebling
*Assistant Examiner*—Kathryn Gorgos
*Attorney, Agent, or Firm*—Herbert Dubno

[57] ABSTRACT

The membrane electrolyzer comprises parts which have been provided for or used in a diaphragm electrolyzer. within a single frame of the membrane electrolyzer are contained from one to three anodes, which have been provided for or used in a diaphragm electrolyzer. Each anode has electrochemically active anode surfaces having a grid structure and a current conductor, which is disposed between the anode surfaces and connected to the frame. The current conductors of the anodes preferably extend through the frame and are connected to a current-carrying bar or plate.

3 Claims, 2 Drawing Sheets

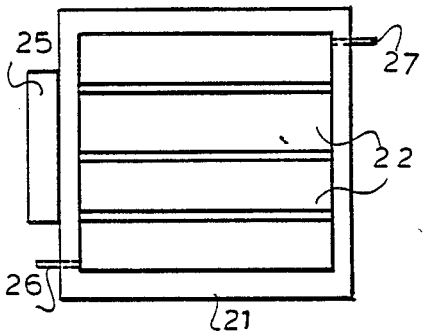
FIG.4
FIG.5
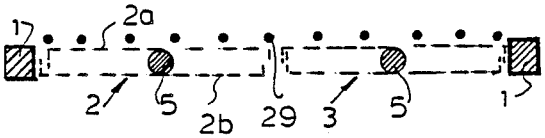
FIG.6
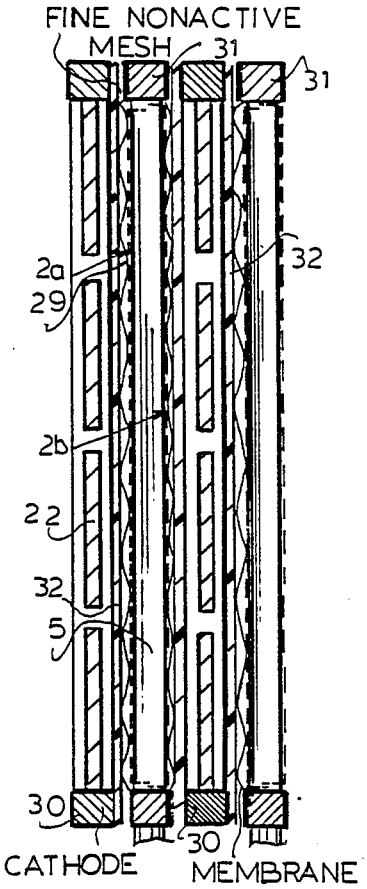

MEMBRANE ELECTROLYZER

FIELD OF THE INVENTION

My present invention relates to a membrane electrolyzer for producing hydrogen, chlorine, and alkali hydroxide from an alkalki chloride solution, wherein a semipermeable membrane having cation exchange properties is disposed between each anode and cathode, and the membrane electrolyzer comprises parts provided for or used in a diaphragm electrolyzer.

OBJECT OF THE INVENTION

It is an object of the invention substantially to reduce the costs of manufacturing a membrane electrolyzer by the use of parts which have been provided for use in a diaphragm electrolyzer and may have been used before.

SUMMARY OF THE INVENTION

This is accomplished in accordance with the invention in that the anodes of the membrane electrolyzer have a frame in which one to three anodes provided for or used in a diaphragm electrolyzer are secured and each anode has electrochemically active anode surfaces having a grid structure and a current conductor, which is disposed between the anode surfaces and is connected to the frame.

More specifically a membrane electrolysis cell according to the invention can comprise:

a generally planar anode assembly;

respective cation-exchange semipermeable membranes flanking the anode assembly; and respective cathodes flanking the semipermeable membranes, the anode assembly comprising:

an anode frame, and between one and three diaphragm-electrolyzer anodes received in the frame, each of the anodes being formed with active surfaces having a grid structure, and a current conductor electrically connected to the surfaces and connected to the frame.

The anodes which are secured in the frame may have been used before in a diaphragm electrolyzer or may have originally been made for that purpose and have been kept in stack.

The anodes for a diaphragm electrolyzer have anode faces having a grid structure and may consist, e.g., of expanded metal. Expensive metals, such as titanium, are used to make them. For an alteration of electrolyzers for use in the membrane process, which is much more modern and much more effective, it is of great importance regarding the cost that existing anodes for a diaphragm electrolysis can still be used. In that case, the costs of manufacturing the membrane electrolyzer can be reduced by 20 to 30%.

BRIEF DESCRIPTION OF THE DRAWING

The above and other objects, features and advantages of the invention will become more readily apparent from the following description, reference being made to the accompanying highly diagrammatic drawing in which:

FIG. 4 is an elevation showing a cathode on a smaller scale;

FIG. 5 is a transverse sectional view showing an anode that is provided with an electrochemically inactive, fine-mesh net; and FIG. 6 is a section through the membrane electrolyzer cell.

SPECIFIC DESCRIPTION

Figure 1:
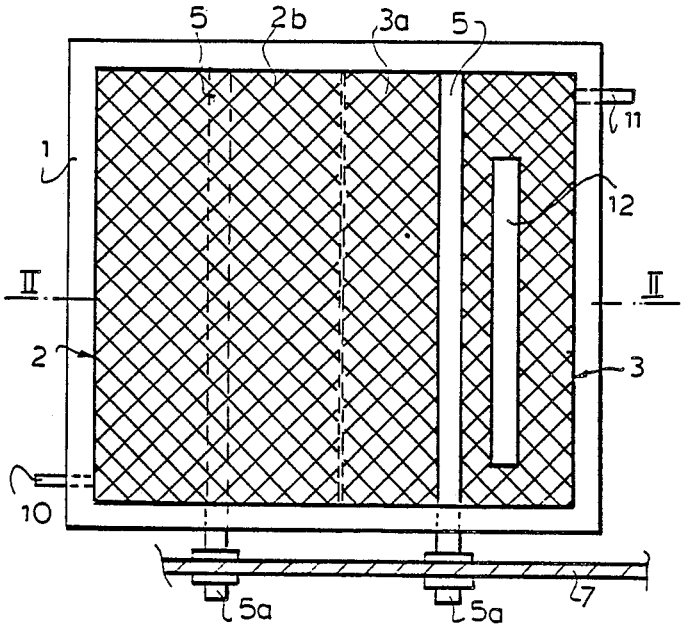
FIG. 1 is an elevational view showing an anode for an electrolyzer cell according to the invention.
Figure 2:
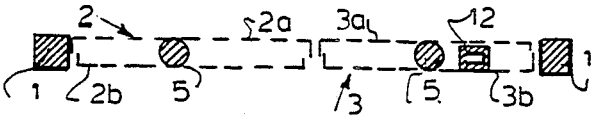
FIG. 2 is a transverse sectional view taken on line II—II in FIG. 1.

The anode shown in FIGS. 1 and 2 is intended for a membrane electrolyzer and comprises a frame 1, which consists, e.g., of titanium and in which two anodes 2 and 3 are secured, which have been provided for use in a diaphragm electrolyzer or have been used therein. The anodes 2 and 3 have electrochemically active anode surfaces 2*a*, 2*b*, and 3*a*, 3*b*, which have a grid structure. The front anode surface 3*b* has been omitted in FIG. 1 so that the interior of the anode 3 can be shown more clearly.

A current conductor 5 usually made of copper extends between the anode surfaces of each anode. The lower end of the current conductor 5 extends through the frame so that the free end 5*a* of the current conductor can be connected to a current-carrying plate 7.

The alkali chloride brine to be electrolyzed is introduced into each cell through a small pipe 10, which extends through the frame. The anolyte and chlorine are withdrawn through line 11.

If a gas-free space is to be formed in the interior of the anode, a metal tube 12 may be inserted between the anode surfaces so that the liquid can flow down freely in that tube whereas gas bubbles will rise outside the tube 12, particularly in front of the anode surfaces. This will result in a desired circulation of the electrolyte so that a depletion of NaC1 in the electrolyte close to the diaphragm will be avoided.

Figure 3:
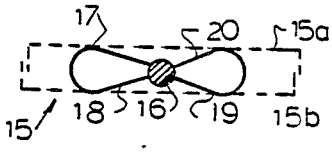
FIG. 3 is a transverse sectional view showing a modified anode of a diaphragm electrolyzer.

FIG. 3 is a transverse sectional view showing on a slightly larger scale a modified diaphragm anode 15, which may also be installed in the frame 1. The anode surfaces 15*a* and 15*b* do not contact the current conductor 16 but receive current via current-distributing metal plates 17, 18 19, which are connected to the current conductor 16.

The current-distributing metal plate 19 and the current conductor 16 are combined to form a closed cross-section and the current-distributing metal plate 19 constitutes a hollow body or duct 20, which is axially parallel to the current conductor 16.

The duct 20 promotes the downward flow of the electrolyte between the anode surfaces 15*a* and 15*b* like the metal tube 12 shown in FIG. 1 and, thus, promotes the circulation of the electrolyte so that the above-mentioned advantages are afforded.

Together with properly shaped cathodes, the described anodes for a membrane electrolysis may be used in the sequence anode—membrane—cathode—membrane—anode etc. to provide an electrolyzer of the filter press type. In that case, the cathode may be designed as desired and may be platelike. An example of a cathode is shown in FIG. 4.

Horizontal plates 22 have been secured in a frame 21 and gaps 23 for an escape of gas have left between the plates 22. A lateral tongue 25 is provided as an electric terminal. Alkali chloride brine is supplied through line 26. Catholyte and hydrogen are withdrawn through line 27. Details of the cathode, which is known per se, are described in U.S. Pat. No. 4,474,612.

FIG. 5 is a view corresponding to FIG. 2 and shows the arrangement of an electrochemically inactive net 29 in front of the anodes 2 and 3. The net may consist, e.g., of titanium and has no activated coating. On the other hand, an activated coating, e.g., of ruthenium oxide, is provided on the anodes 2 and 3. The net is secured to the frame 1 and serves to support the membrane and bridges gaps, corners and sharp edges on the top of the anodes 2, 3. A net 29 may be provided on both outsides of the anodes.

The cell shown in FIG. 6 may be one of a large number provided in a stack. It has cathodes 30 of the type shown in FIG. 4 with plates 22, anode assemblies 31 as shown in FIGS. 1 and 2 with active surface 2*a*, 2*b* in contact with the current conductor 5, membrane 32 and fine mesh nets 29 as in FIG. 5.

I claim:

1. A membrane electrolyzer for electrolyzing an alkali chloride solution to produce hydrogen, chlorine and an alkali hydroxide, said membrane electrolyzer comprising:

a generally planar anode assembly;

respective cation-exchange semipermeable membranes flanking said anode assembly; and respective cathodes flanking said semipermeable membranes, said anode assembly comprising:

an anode frame, between one and three diaphragm-electrolyzer anodes are received in said frame, each of said anodes being formed with two active surfaces having a grid structure, and a current conductor within each of said anodes electrically connected to said surfaces and connected to said frame, a metal tube positioned in each anode electrically connected to the respective active surfaces thereof and axially parallel to the current conductor, said tube being formed by current distributing metal plates connected to the respective current conductor, and an electrochemically inactive fine-mesh net secured to the frame and being positioned on each of said active surfaces.

2. The membrane electrolyzer defined in claim 1 wherein each said current conductor extends through said frame and is connected outside said frame to a current-carrying bar.

3. The membrane electrolyzer defined in claim 1 wherein said current conductor is provided with current distributing metal plates connected to said grid structure for electrically connecting said grid structure to said current conductor.

* * * * *